US006589066B1

(12) United States Patent
Wu

(10) Patent No.: US 6,589,066 B1
(45) Date of Patent: Jul. 8, 2003

(54) ELECTRICAL CONNECTOR HAVING A LATCH MECHANISM

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/209,553

(22) Filed: Jul. 30, 2002

(51) Int. Cl.[7] ..... H01R 13/627
(52) U.S. Cl. ..... 439/352; 439/357
(58) Field of Search ..... 439/352, 350, 439/353, 354–358, 372, 607, 610

(56) References Cited

U.S. PATENT DOCUMENTS 3,548,455 A * 12/1970 Ezure ..... 439/352
4,634,204 A * 1/1987 Detter et al. ..... 439/347
5,564,939 A 10/1996 Maitani
5,634,809 A * 6/1997 Hirai ..... 439/352
5,951,316 A * 9/1999 Kawano et al. ..... 439/352
6,394,842 B1 * 5/2002 Sakurai et al. ..... 439/607

* cited by examiner

*Primary Examiner*—Hien Vu
(74) *Attorney, Agent, or Firm*—Wei Te Chung

(57) ABSTRACT

An electrical connector (1) includes a base (10) and a cover (20) assembled together. The base and cover each define a pair of channels (121, 221). A pull tab (80) has an operation portion (81) and a pair of arms (82) extending from the operation portion. The pair of arms are received in the channels with the operation portion located outside of the base and cover. Each arm has a latch releasing portion (83) at a free end thereof. A pair of latch springs (70) each has a first claw portion (72) engaging with the base, a second claw portion (73) for engaging with a complementary connector, and a sloping portion (712) between the first and second claw portion. The sloping portions have inner faces engaging with the latch releasing portions. The latch releasing portions push the sloping portions to lead the second claw portions separating the complementary connector mated with the present electrical connector when the pull tab is pulled rearwards.

8 Claims, 9 Drawing Sheets

ELECTRICAL CONNECTOR HAVING A LATCH MECHANISM

BACKGROUND OF THE INVENTION

1. Field of the Invention

The present invention relates to an electrical connector, and particularly to an electrical connector having latch springs for engaging with and releasing a mated complementary connector.

2. Description of Prior Art

Referring to U.S. Pat. No. 5,564,939, a conventional electrical connector disclosed in the patent has a pair of latch springs 22 and 22A respectively attached on opposite sides of a housing 21 of the connector. An operating member 23 has a pair of latch releasing cams 23-4 located below angled portions 22-4 of the latch springs 22, 22A. When an operator pulls a pull tab 23-8 of the operating member 23 backwardly, the latch releasing cams 23-4 exert outward forces on the angled portions 22-4 and U-shaped claws 22-1 slip out to release a mated complementary connector. Because the operating member 23 and the latch springs 22, 22A are positioned outside of the housing 21, they are very easy to be damaged when a force is exerted thereon. When two or more such connectors are arranged side by side, a relatively large space is needed between every two connectors and this adversely affects the compact design of an electronic system including such connectors. To overcome the above mentioned disadvantages, an electrical connector is needed which has latch springs which will not increase the width of the connector, and which are so positioned that a better protection is provided to the latch springs to prevent them from damage by an external force.

SUMMARY OF THE INVENTION

It is an objective of the present invention to provide an electrical connector having latch springs assembled therein for engaging with and releasing a mated complementary connector; the latch springs will not increase the width of the connector so a number of the connector can be compactly arranged side by side together; furthermore, the latch springs are so positioned that they are protected from an external force to act thereon whereby a damage of the latch springs by the external force can be prevented; and the latch springs are more securely assembled to the connector so that a separation of the latch springs from the connector after repeat operations of the connector is avoided.

In order to achieve the object above-mentioned, an electrical connector in accordance with the present invention includes a base defining a pair of elongated first channels on opposite sides thereof, a cover being assembled to the base and defining a pair of elongated second channels on opposite sides thereof corresponding to the first channels of the base. A pull tab has an operation portion and a pair of arms extending from a pair of ends of the operation portion. The pair of arms is respectively received in the first and second channels, and the operating portion locates outside the base and the cover. Each arms has a latch releasing portion at a free end thereof. A pair of latch springs is cooperated with the pull tab. Each latch spring has a first claw portion engaging with the base, a second claw portion for engaging with a complementary connector when said complementary connector is mated with the electrical connector, and a sloping portion between the first and second claw portion. The slope portions engage with corresponding latch releasing portion of the pull tab. When the pull tab is pulled rearwards, the latch releasing portions push the sloping portions. The sloping portions deflect outwardly to motivate the second claw portions to move outwardly accordingly whereby a latch of the second claws with the complentray connector is released.

Other objects, advantages and novel features of the invention will became more apparent from the following detailed description when taken in conjunction with the accompanying drawings.

DETAILED DESCRIPTION OF THE INVENTION

Figure 1:
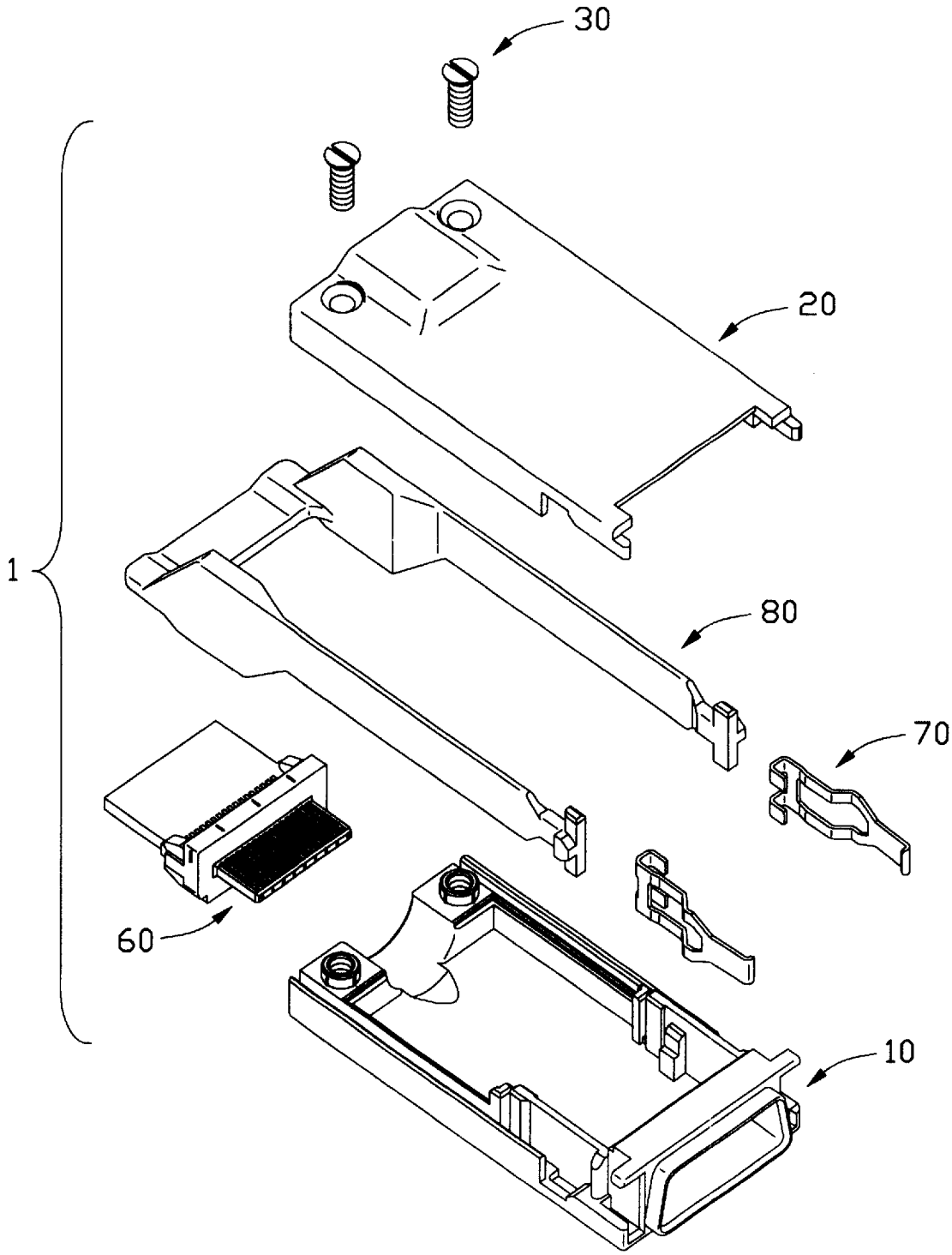
FIG. 1 is an exploded perspective view of an electrical connector in accordance with the present invention.

Referring to FIG. 1, an electrical connector 1 in accordance with the present invention comprises a base 10, a cover 20 for being assembled to the base 10, a pair of screws 30 for securing the cover 20 on the base 10, a connector subassembly 60, a pair of latch springs 70, and a pull tab 80.

Figure 2:
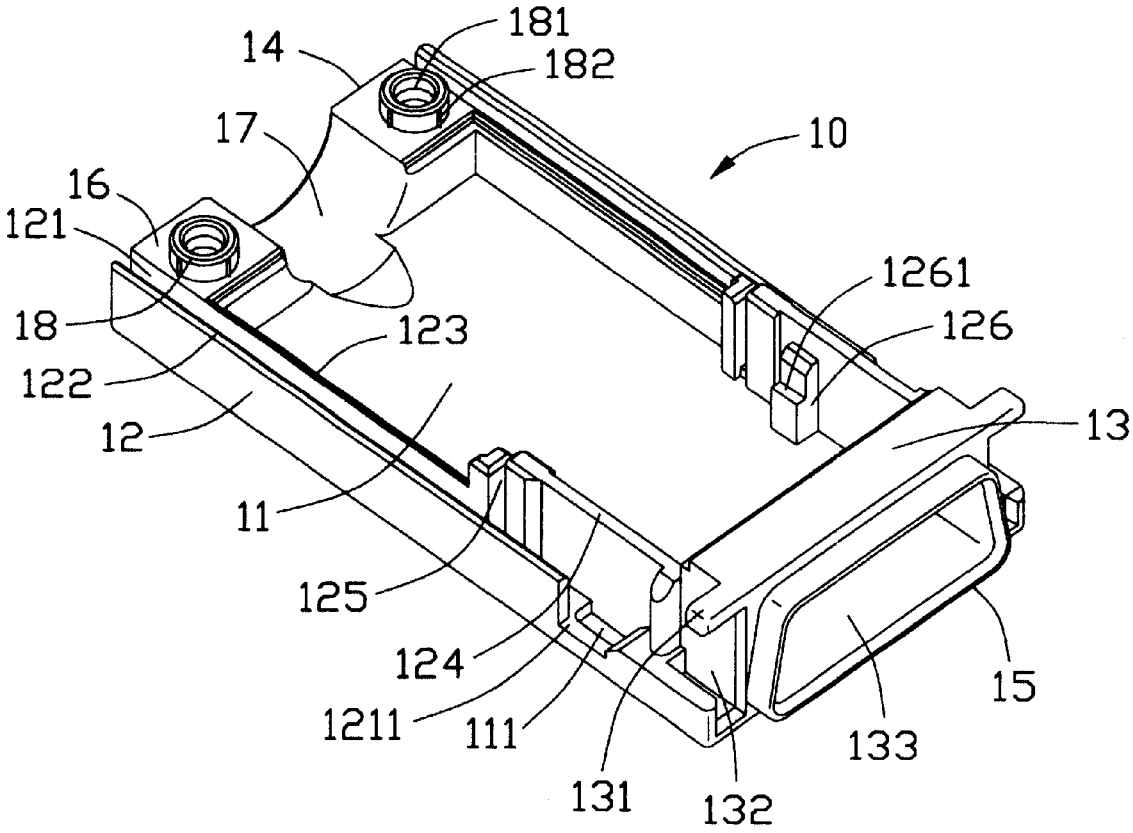
FIG. 2 is an enlarged perspective view of a base shown in FIG. 1.

The base 10 and the cover 20 are formed by die casting metallic material, for example, aluminum alloy. Referring to FIG. 2, the base 10 comprises a base plate 11 and a pair of sidewalls 12 upwardly extending from opposite lateral sides of the base plate 11. Each sidewall 12 defines an elongated channel 121 from a rear end 14 toward a front end 15 of the base 10 and through a top engaging face 16 thereof. Each sidewall 12 is divided into an outer wall 122 and an inner wall 123 by the channel 121. The inner walls 123 each have a higher shoulder portion 124 adjacent to the front end 15. The shoulder portions 124 each define a vertical slit 125 at a rear end thereof. The outer walls 122 each define a cutout 1211 adjacent to the front end 15. A pair of blocks 126 is formed on inner sides of the shoulder portions 124 of the inner walls 123. Each block 126 defines a step portion 1261. The base plate 11 defines a pair of grooves 111 each being located between the shoulder portion 124 of a corresponding inner wall 123 and a corresponding cutout 1211. A mating frame 13 is formed at the front end 15 of the base 10. The mating frame 13 defines an opening 133 through the front end 15. A pair of engaging ears 131 is formed on opposite sides of a top of the mating frame 13 and extends laterally. A pair of engaging spaces 132 is defined in opposite sides of the mating frame 13 and between the engaging ears 131 and the base plate 11. The base 10 has a first substantially semicircular opening 17 at the rear end 14. A pair of posts 18 protrudes upwardly from the engaging face 16, located respectively at opposite sides of the first opening 17. Each post 18 defines a screw hole 181 therein and has four ribs 182 on a circumferential periphery thereof.

Figure 3:
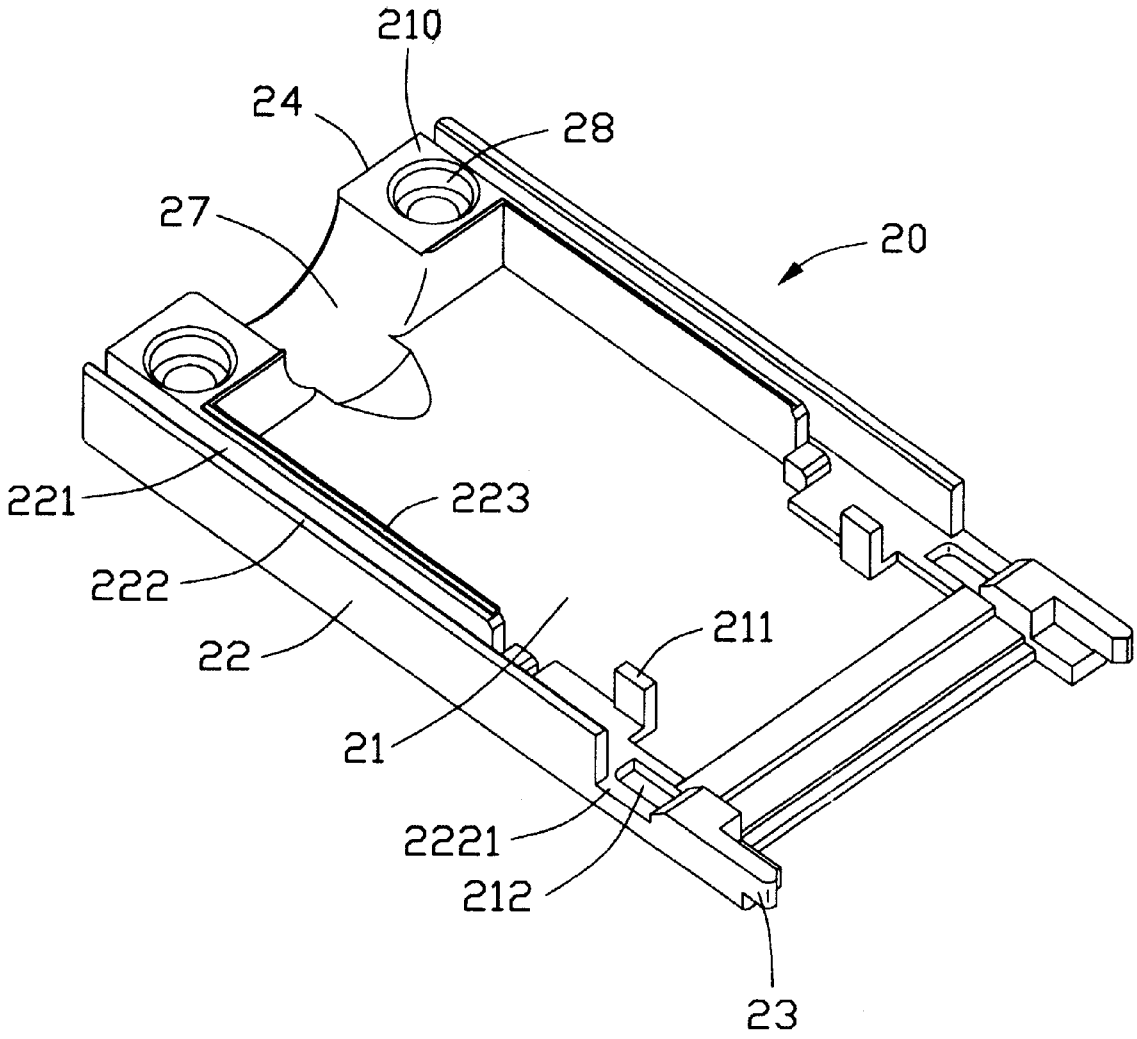
FIG. 3 is an enlarged perspective view of a cover shown in FIG. 1 from the bottom aspect.

Referring to FIG. 3, the cover 20 comprises a cover plate 21 and a pair of sidewalls 22 downwardly extending from opposite lateral sides of the cover plate 21. Each sidewall 22 defines an elongated channel 221 corresponding to the channel 121 of the base 10. Each sidewall 22 is divided into an outer wall 222 and an inner wall 223 by the channel 221. A pair of blocks 211 extends downwardly from the cover plate 21 corresponding to the blocks 126. A pair of grooves 212, corresponding to the grooves 111 in the base 10, is defined in the cover plate 21 in inner sides of a pair of cutouts 2221 which is corresponding to the cutouts 1211 in the base 10. A pair of projections 23 extends forwardly from opposite sides of a front end of the cover plate 21. A semicircular second opening 27 is defined in a rear end 24 of the cover plate 21 corresponding to the first opening 17 of the base 10. A pair of holes 28 is defined in opposite sides of the second opening 27. Each hole 28 has a diameter generally equal to an outer diameter of each of the posts 18.

Figure 4:
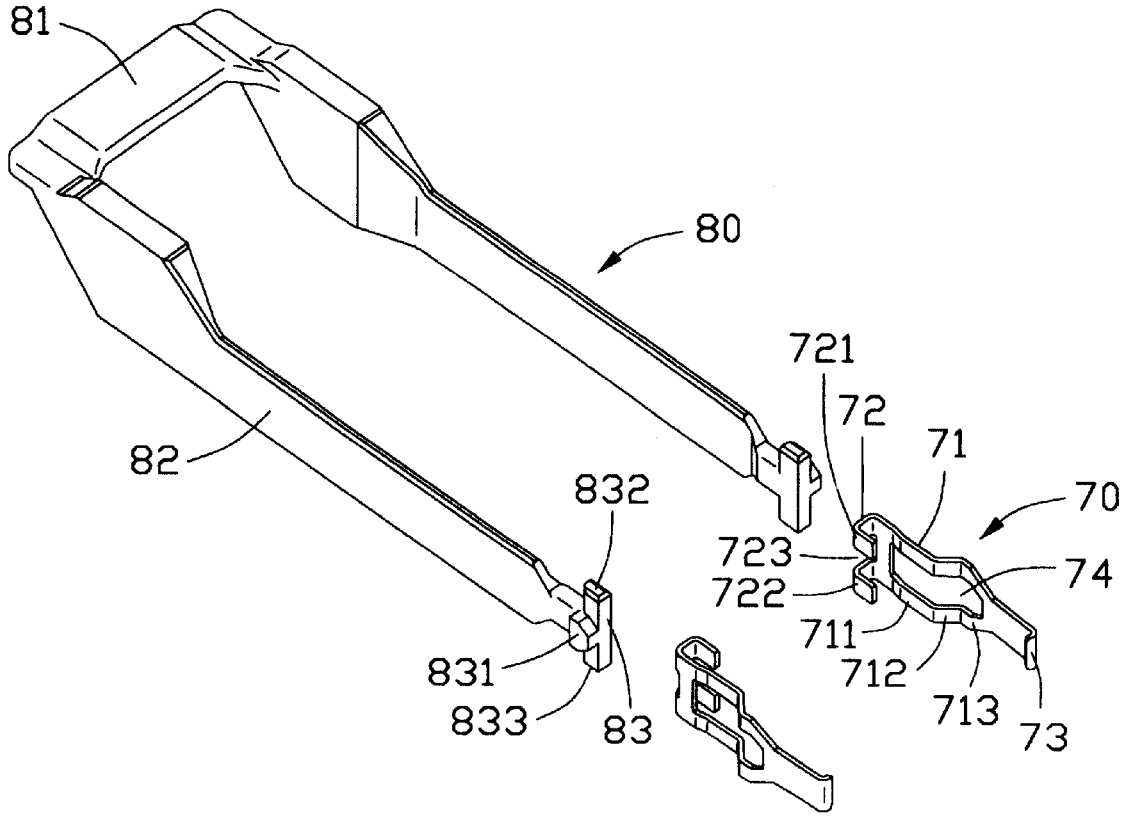
FIG. 4 is an enlarged perspective view of latch springs and a pull tab shown in FIG. 1.

Referring to FIG. 4, each of the latch springs 70 is formed by stamping a metal sheet and has a body portion 71, a U-shaped claw portion 72 formed at a rear end of the body portion 71, and an L-shaped claw portion 73 formed at a front end of the body portion 71. The U-shaped claw portion 72 has upper and lower claw portions 721, 722, and a gap 723 defined between the upper and lower claw portions 721, 722. An elongated cutout 74 is defined in the body portion 71 in a front-to-rear direction. The body portion 71 comprises a rear portion 711, a sloping portion 712 inclined outwardly from the rear portion 711, and a front portion 713 extending inwardly from the sloping portion 712.

The pull tab 80 comprises an operation portion 81, a pair of arms 82 extending forwardly from opposite sides of the operation portion 81, and a pair of latch releasing portion 83 formed at front ends of the arms 82, respectively. Each latch releasing portion 83 has upper and lower tip ends 832, 833, and a protrusion 831 protruding outwardly from an outside face thereof.

Figure 5:
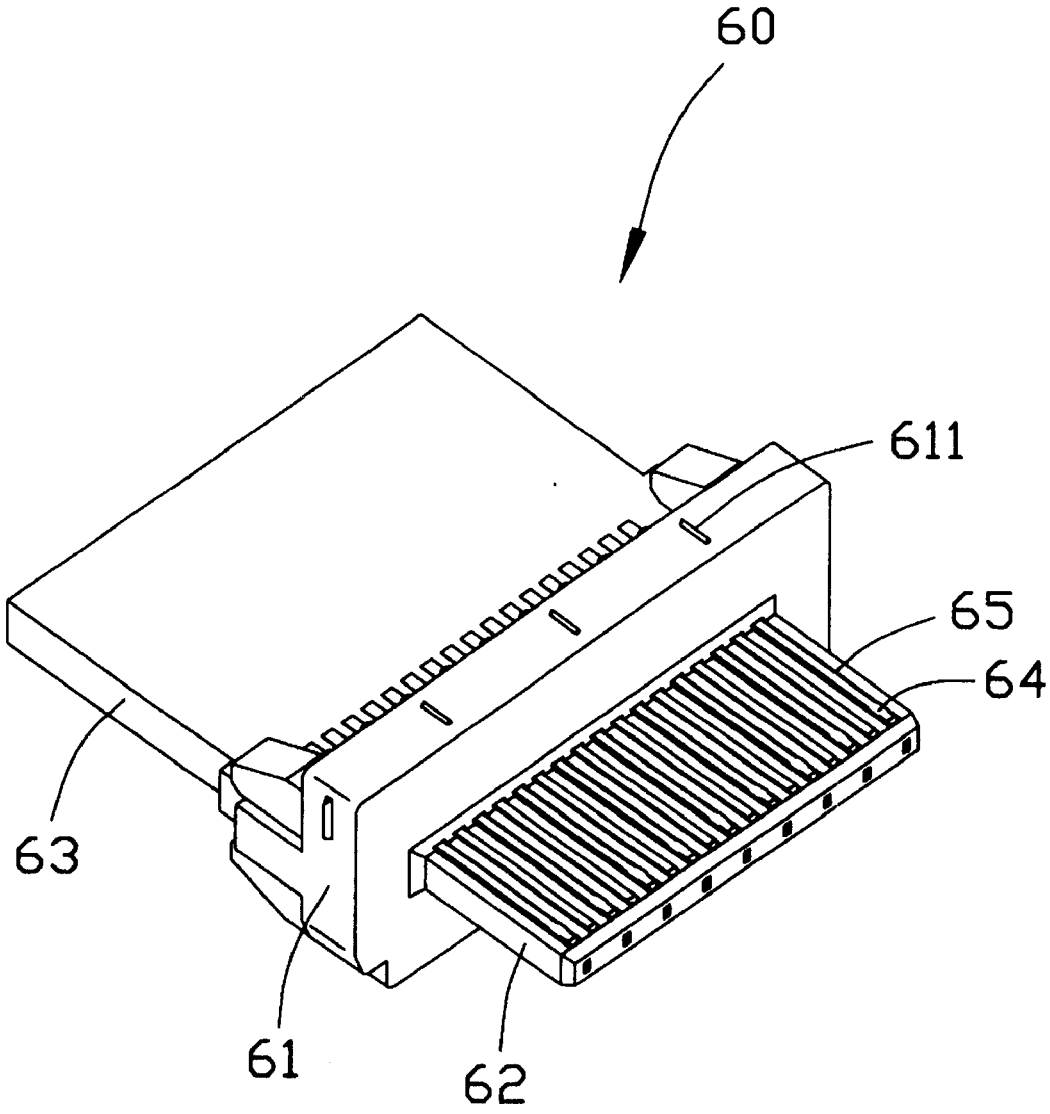
FIG. 5 is an enlarged perspective view of a connector subassembly shown in FIG. 1.

Referring to FIG. 5, the connector subassembly 60 comprises an insulating housing 61, a tongue portion 62 extending forwardly from the housing 61, a printed circuit board (PCB) 63 assembled to a rear side of the housing 61. A plurality of passageways 65 is defined in upper and lower surfaces of the tongue portion 62. A plurality of terminals 64 is received in the passageways 65 of the tongue portion 62 and extends through the housing 61 to electrically connect the PCB 63. The housing 61 has a plurality of ribs 611 formed on a top surface and opposite side surfaces thereof.

Figure 6:
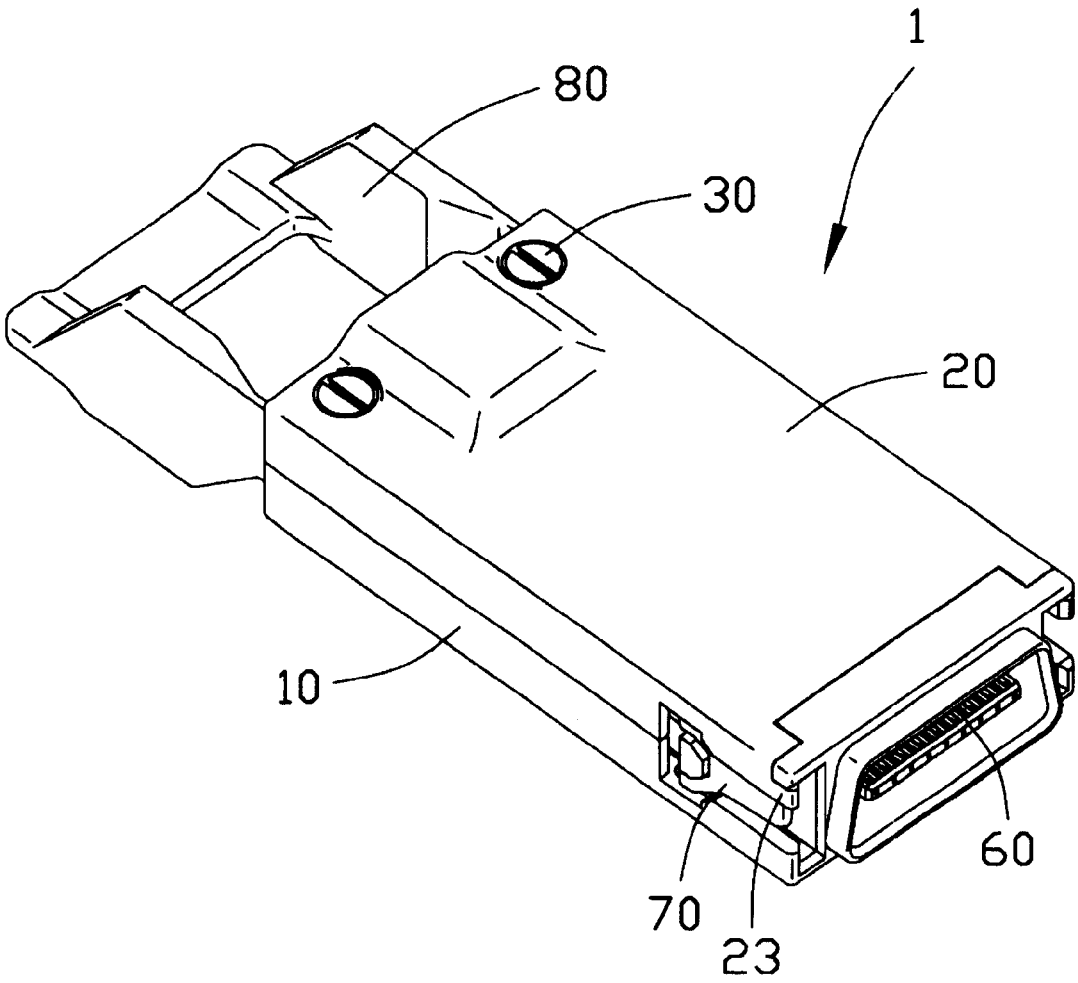
FIG. 6 is an assembled view of the electrical connector shown in FIG. 1.
Figure 7:
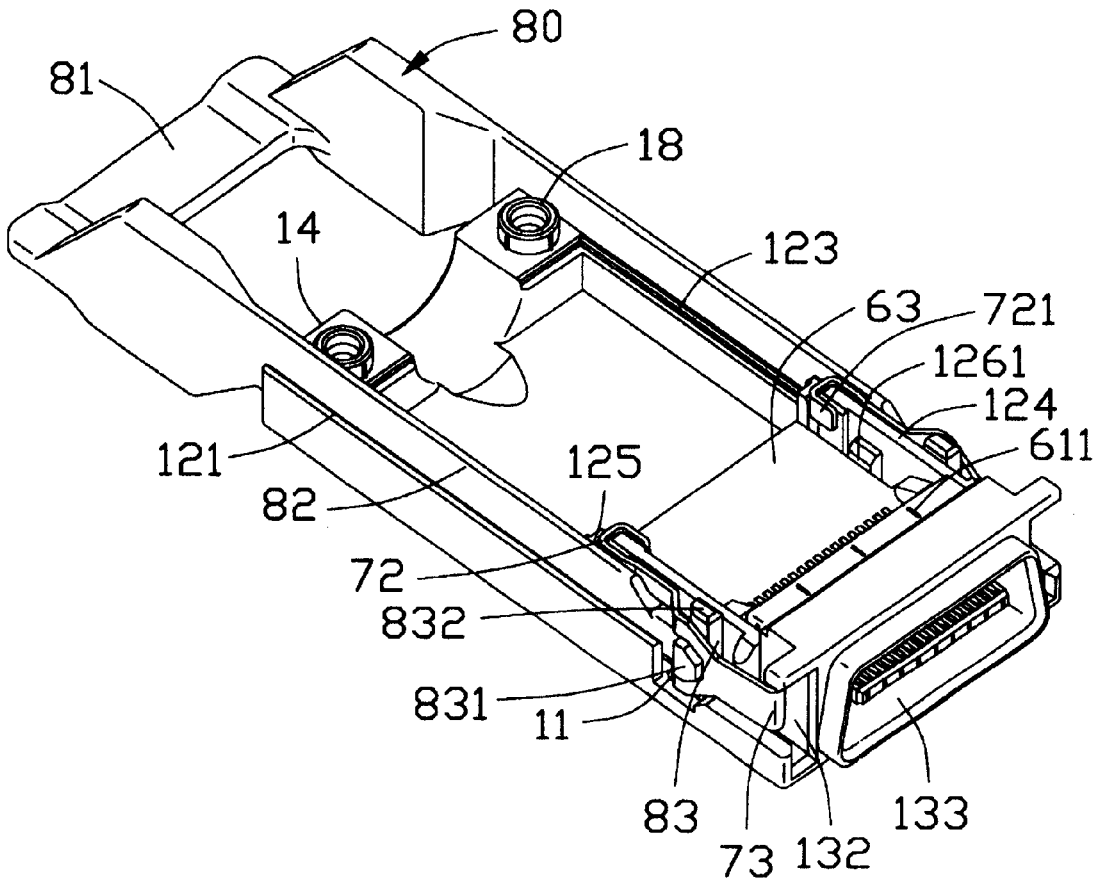
FIG. 7 is an similar to FIG. 6, with the cover being removed.

Referring to FIGS. 6 and 7, in assembly, the connector subassembly 60 is assembled to the base 10 with the tongue portion 62 received in the opening 133 and the ribs 611 on opposite side surfaces of the housing 61 engaged with inner surfaces of the shoulder portions 124 of the inner walls 123. The PCB 63 is received in the base 10 between the two sidewalls 12 and positioned upon the step portions 1261 of the blocks 126. The two latch springs 70 are respectively assembled to the pull tab 80 by extending the protrusions 831 into the cutouts 74 from inner faces of the latch springs 70, whereby the latch releasing portions 83 engage with the inner faces of the latch springs 70, respectively. The latch releasing portions 83 are positioned at the inner faces of the front portions 713 and the protrusions 831 are fitted into front portions of the cutouts 74. Then, the latch springs 70 together with the pull tab 80 are assembled to the base 10. The arms 82 are placed into the channels 121 with the operation portion 81 located outside the rear end 14 of the base 10. The U-shaped claw portions 72 are received into the slits 125 and engaged with rear ends of the shoulder portions 124 to secure the latch springs 70 to the base 10. The PCB 63 is located in the gap 723 between the upper and lower U-shaped claw portions 721, 722. The lower tip ends 833 of the latch releasing portions 83 are placed in the grooves 111 with the protrusions 831 extending into the cutouts 1211. The L-shaped claw portions 73 extend into the engaging spaces 132 for latching with a complementary connector (not shown). The cover 20 is assembled to the base 10 by placing the projections 23 beneath the pair of engaging ears 131. Then a rear portion of the cover 20 is rotated downwardly about the pair of engaging ears 131 until a bottom face of the cover 20 intimately abuts the top engaging face 16 of the base 10. Upper portions of the arms 82 are received in the channels 221 and the upper tip ends 832 of the latch releasing portions 83 are received into the grooves 212 of the cover 20. The blocks 211 abut a top face of the PCB 63 above the step portions 1261 of the blocks 126 to secure the PCB 63 in position. The posts 18 are received into the holes 28 with the four ribs 182 engaging with inner surfaces of the holes 28. The first and second openings 17 and 27 together form a cable receiving opening for extension of a cable (not shown) therethrough. Finally, the screws 30 are screwed into the screw holes 181 to securely fasten the cover 20 and the base 10 together, whereby the electrical connector 1 in accordance with the present invention is obtained.

An operation of the electrical connector 1 in introduced below.

Figure 8:
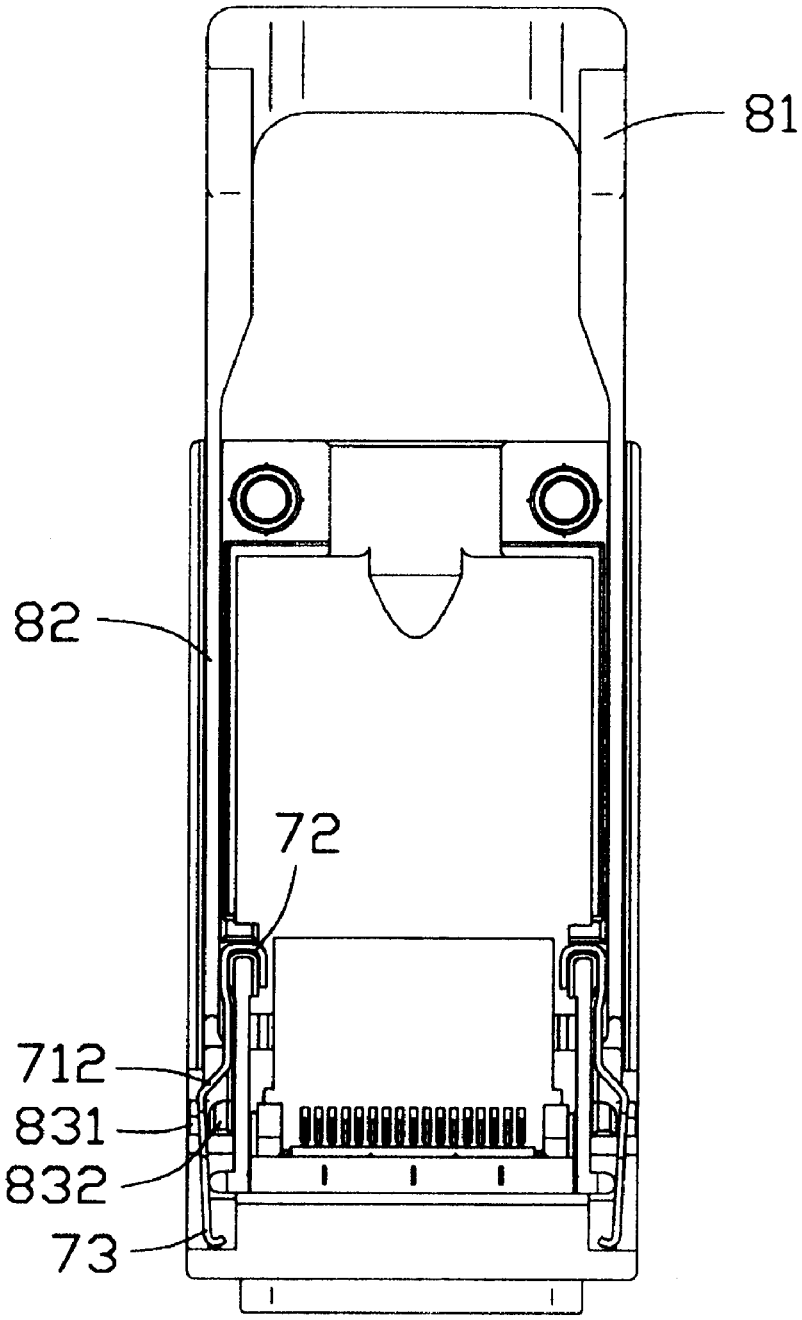
FIG. 8 is a top view of FIG. 7, in which the latch springs are located at a position.
Figure 9:
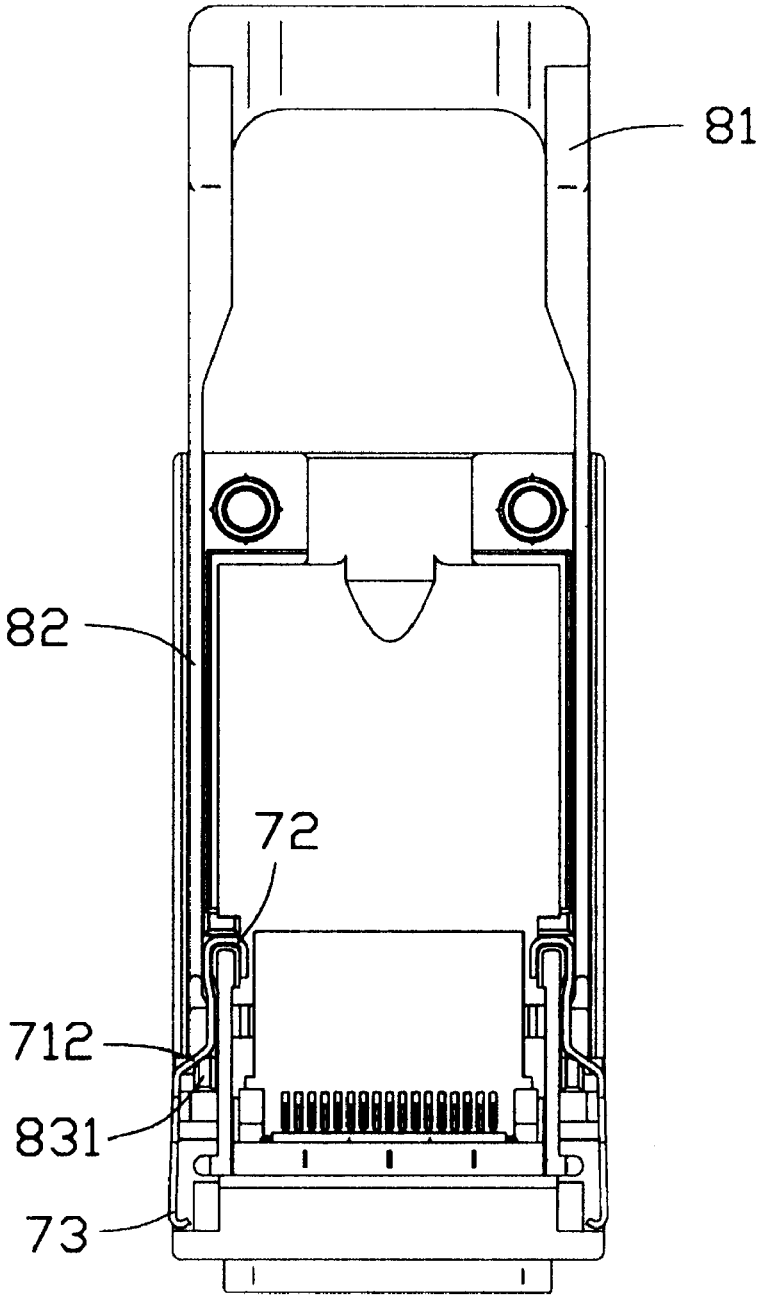
FIG. 9 is a view similar FIG. 8, showing the latch springs being moved to an open position.

Referring to FIGS. 8 and 9, when the complementary connector (not shown) is mated with the electrical connector 1 of the present invention, the L-shaped claw portions 73 clamp corresponding engaging portions of the complementary connector. The electrical connector is unmated with the complementary connector by the following operation. An operator grips the operation portion 81 of the pull tab 80 and pulls it rearwards, whereby the pull tab 80 is moved rearwards. The upper and lower tip ends 832, 833 slide in the grooves 111, 212 and the protrusions 831 slide in the cutouts 74. When the latch releasing portions 83 come into contact with the sloping portions 712, they exert an outward force on inner faces of the sloping portions 712. The latch springs 70 are elastically deformed and the front portions 713 are pushed outwardly. Thus, the L-shaped claw portions 73 are driven to move out of the engaging portions of the complementary connector. Accordingly, the latch springs 70 no longer latch with the complementary connector, and the electrical connector 1 in accordance with the present invention can be readily separated from the complementary connector as mentioned below.

When the upper and lower tip ends 832, 833 are moved to rear ends of the grooves 111, 212 and engage with the cover 20 and the base 10, the force pulling the pull tab 80 is transferred into a force pulling the electrical connector 1. Hence, the electrical connector 1 is pulled out from the complementary connector. When the pulling force acting on the pull tab 80 is released, a spring force of the sloping portions 713 of the latch springs 70 is exerted on the latch releasing portions 83 and the spring force pushes the pull tab 80 back to the original position shown in FIG. 8, so that the latch springs 70 are ready to latch with the complementary connector when the electrical connector 1 in accordance with the present invention mates with the complementary connector again.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mating with a complementary connector, comprising:

a base defining a pair of elongated first channels on opposite sides thereof, a mating frame formed on a front end thereof;

an insulting housing assembled into the mating frame and a plurality of terminals received in the insulating housing;

a cover assembled to the base and defining a pair of elongated second channels on opposite sides thereof corresponding to the first channels of the base;

a pull tab having an operation portion and a pair of arms extending from a pair of ends of the operation portion, the pair of arms respectively received in the first and second channels and the operation portion located outside the base and the cover, each arm having a latch releasing portion at a free end thereof;

a pair of latch springs cooperating with the pull tab, each latch spring having a first claw portion engaging with the base, a second claw portion adapted for securely engaging with the complementary connector when said complementary connector mates with the electrical connector, and a sloping portion between the first and second claw portions and engaging with a corresponding latch releasing portion of the pull tab; and wherein when the pull tab is pulled rearwards, the latch releasing portions push the sloping portions, the sloping portions deflect outwardly to motivate the second claws to move outwardly accordingly whereby a latch of the second claws with the complementary connector is released; wherein the each latch spring defines a cutout in the sloping portion, the latch releasing portion having a protrusion extending into the cutout from an inner face to an outer face of the sloping portion, so that the latch releasing portion contacts with the inner face of the sloping portion of the latch spring; wherein the protrusion protrudes outwardly from an outside face of the latch releasing portion;

wherein the latch releasing portion has upper and lower tip ends, the cover and the base each defines a groove receiving the upper and lower tip ends of the latch releasing portion therein, the tip ends sliding rearwards in the grooves when the pull tab is pulled rearwards; wherein the mating frame has a pair of engaging ears extending outwardly on opposite sides of a top thereof, a pair of projections extends forwardly from opposite sides of the cover, the projections are placed under the pair of engaging ears prevent the cover from being moved upwardly.

2. The electrical connector as described in claim 1, wherein the base has a pair of sidewalls upwardly extending therefrom, the first channels are defined in the sidewalls.

3. The electrical connector as described in claim 2, wherein each sidewall is divided into an outer wall and an inner wall by a corresponding first channel, the inner wall has a shoulder portion adjacent to the mating frame, the shoulder portion defines a vertical slit, the first claw portion is received in the slit and engaged with the shoulder portion to fixedly secure the latch spring to the base.

4. The electrical connector as described in claim 3, wherein cutouts are respectively defined in the side walls of the base and side walls of the cover, the protrusion of the latch releasing portion extends into the cutouts.

5. The electrical connector as described in claim 4, wherein the insulating housing has a tongue portion extending forwardly therefrom, a plurality of passageways is defined in upper and lower faces of the tongue portion, the terminals are received in the passageways, and a printed circuit board (PCB) is assembled to a rear side of the insulating housing.

6. The electrical connector as described in claim 5, wherein the terminals are electrically connected with the PCB.

7. The electrical connector as described in claim 1, wherein the base and the cover are made of metallic material.

8. The electrical connector as described in claim 1, wherein the base has a pair of screw holes, a pair of screws extends through the cover and threadedly engage with the screw holes to thereby fasten the cover and the base together.

* * * * *